US007347212B2

(12) United States Patent
Rosenbauer

(10) Patent No.: US 7,347,212 B2
(45) Date of Patent: Mar. 25, 2008

(54) FILTER DEVICE

(75) Inventor: Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 149 days.

(21) Appl. No.: 11/068,644

(22) Filed: Feb. 28, 2005

(65) Prior Publication Data

US 2005/0199273 A1 Sep. 15, 2005

Related U.S. Application Data

(63) Continuation of application No. PCT/EP03/09242, filed on Aug. 20, 2003.

(30) Foreign Application Priority Data

Aug. 28, 2002 (DE) ..... 102 39 495

(51) Int. Cl.
*B08B 3/00* (2006.01)

(52) U.S. Cl. ..... 134/110; 134/56 R; 134/56 D; 134/57 D; 134/109

(58) Field of Classification Search ..... 134/56, 134/56 D, 57 D, 109, 110, 56 R
See application file for complete search history.

(56) References Cited

U.S. PATENT DOCUMENTS

| | | | | |
|---|---|---|---|---|
| 2,854,141 A | | 9/1958 | Barnstead | |
| 3,772,902 A | | 11/1973 | Noguchi | |
| 3,989,054 A | * | 11/1976 | Mercer | 134/104.1 |
| 4,986,914 A | * | 1/1991 | Franks | 210/502.1 |
| 5,069,755 A | | 12/1991 | Durr | |
| 5,779,812 A | | 7/1998 | Thies | |
| 2004/0007253 A1 | * | 1/2004 | Jung et al. | 134/10 |

FOREIGN PATENT DOCUMENTS

| | | | |
|---|---|---|---|
| DE | 296 07 001 U1 | | 7/1996 |
| GB | 2 096 456 A | | 10/1982 |
| WO | WO9711632 | * | 8/1996 |

OTHER PUBLICATIONS

International Search Report for PCT/EP03/09242.

* cited by examiner

*Primary Examiner*—Michael Barr
*Assistant Examiner*—Rita R Patel
(74) *Attorney, Agent, or Firm*—Russell W. Warnock; James E. Howard

(57) ABSTRACT

There is provided a filter device that enables less frequent manual or self cleaning of the filter surface. The filter is particularly suitable for an aquiferous domestic appliance, such as a dishwashing machine, in which the cleaning effect occurring with alternating pumping is further increased, such that manual cleaning of the filter surface need take place less often, or, respectively, self-cleaning of the filter surface occurs.

2 Claims, 2 Drawing Sheets

FILTER DEVICE

Figure 1:
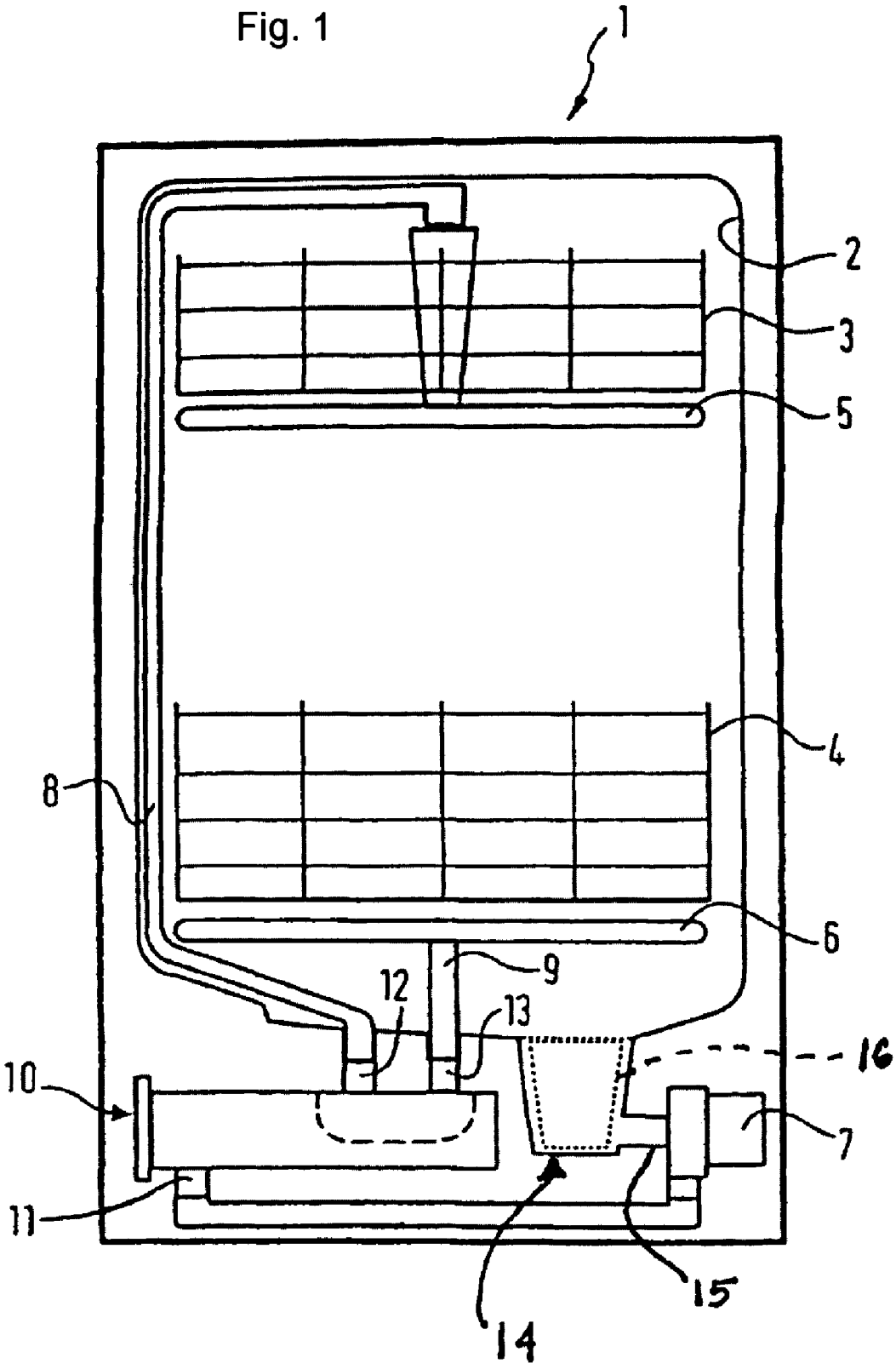

The invention relates to a filter device comprising at least one filter body with a filter surface. Such filters are often arranged in aquiferous domestic appliances, in particular in dishwashing machines.

With conventional filter devices, e.g. for dishwashing machines, a filter body is provided with one or more filter surfaces, whereby the filter surface is preferably made from materials which are substantially corrosion-resistant to constituents dissolved in a selected cleaning liquid. For this reason the filter surfaces e.g. in conventional dishwashing machines are made either of stainless steel or a high-quality synthetic material, where the surface quality of the filter surface is significant also, in addition to the choice of material. In practice it has been shown that small dirt particles and/or bacteria can lodge in furrows and surface roughness where there is a coarse surface quality, so that a filter surface appears unclean from both the hygienic and optical viewpoints. With dishwashing machines it is known (e.g. see DE-3114 663 A1) to reverse the direction of flow through the filter surface at least for a brief time, so-called alternating pumping, resulting in certain self-cleaning of the filter devices, though manual cleaning of the filter surfaces is still required from time to time.

The object of the present invention is therefore to provide a filter device, which enables less frequent manual cleaning of the filter surface or respectively self-cleaning of the filter surface; the object is also to provide an aquiferous domestic appliance, in particular a dishwashing machine, in which the cleaning effect occurring with alternating pumping is further increased, such that, as already mentioned, manual cleaning of the filter surface need take place less often, or respectively self-cleaning of the filter surface occurs.

This task for the filter device is solved by the inventive filter device having the characteristics as per Claim 1. This task is solved for the aquiferous domestic appliance and for the dishwashing machine according to the characteristics of the further independent claims. Advantageous further developments of the present invention are characterised in the independent claims.

The inventive filter device has an adhesion-reducing layer at least on the side of the filter surface facing the material to be filtered.

The advantage of the inventive filter device is that both particles and material to be filtered with dissolved constituents now find it difficult to adhere to the filter surface, so that dirt particles and/or bacteria and also constituents dissolved in material to be filtered do not adhere to the filter surface, thus enabling manual cleaning of the filter surface or respectively self-cleaning of the filter surface to take place less often.

According to an advantageous embodiment of the invention there is provided on both sides of the filter surfaces an adhesion-reducing layer, so that adhesion of dirt particles and/or bacteria is substantially reduced on both sides of the filter surface also with the abovementioned alternating pumps.

In a particularly advantageous manner the adhesion-reducing layer essentially consists of a so-called diamond-like carbon (DLC) substance.

The abovementioned advantages of the inventive filter device are naturally used in the inventive arrangement of at least one of the abovedescribed inventive filter devices in an aquiferous domestic appliance as well as in an inventive dishwashing machine.

By way of advantage with the inventive arrangement of one of the abovedescribed inventive filter devices in a dishwashing machine the filter surface is provided with an adhesion-reducing layer at least on the side facing a rinse container of the dishwashing machine.

The advantage of the inventive filter device is that both particles and material to be filtered with dissolved constituents now find it difficult to adhere to the filter surfaces, so that in particular with use of a diamond-like carbon coating dirt particles do not adhere to the filter surface and with aquiferous domestic appliances and dishwashing machines constituents dissolved in the selected cleaning liquid do not adhere to the filter surface. With the above described alternating pumping a particularly high self-cleaning effect is achieved when the inventive filter device is utilized.

The adhesion-reducing layer can already be applied to the metal foils, from which the filter surfaces are made. Yet it is also possible to affect coating with diamond-like carbon immediately after the filter surfaces are created. There is the advantage with retro-coating that the drop in surface quality resulting from punching out the filter apertures can be substantially compensated, since the diamond-like carbon coating can also be applied in the cross-sectional spaces of the filter surface opening. On the other hand coating the sheets in advance can be more economical prior to creating the filter holes.

Figure 2:
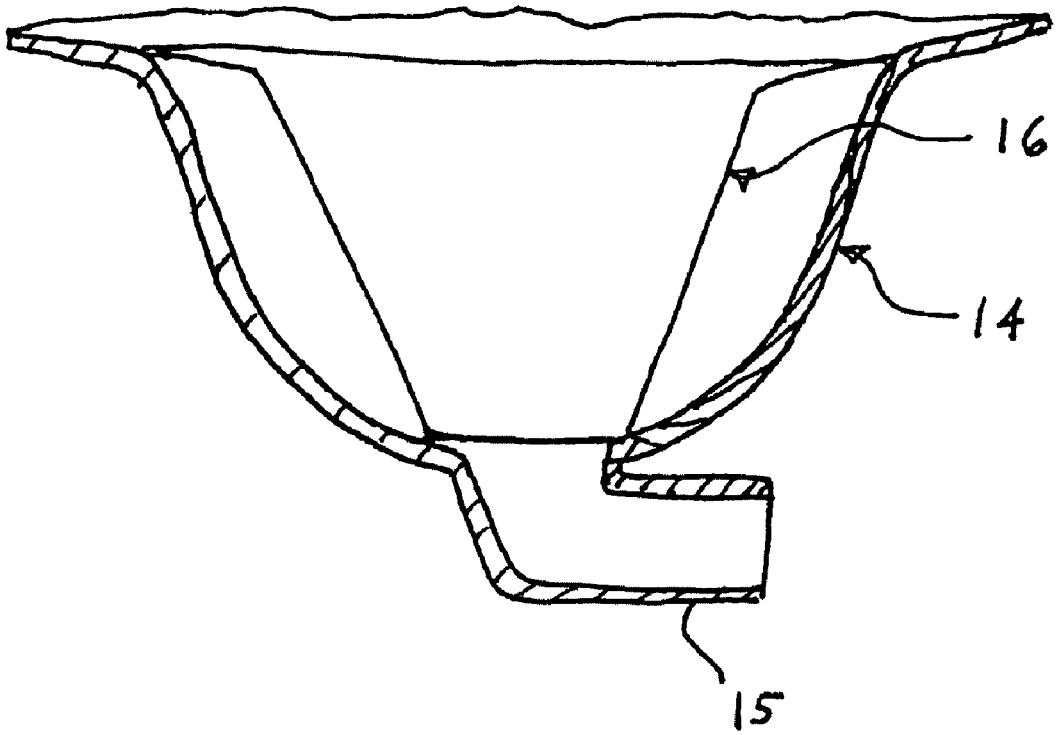

The invention will now be explained in greater detail with reference to an arrangement for executing the method of the present invention illustrated in the figures of the drawings, in which:

FIG. 1 is a front plan view, in partial section, of a dishwasher configured with one preferred embodiment of the present invention; and FIG. 2 is an enlarged front elevational view of a sump and a filter of the dishwasher shown in FIG. 1.

With reference to FIG. 1, an aquiferous domestic appliance is representatively shown in a configuration as a dishwasher 1 that includes a washing compartment 2 containing one or more racks 3,4 for holding dishes or other household items to be cleaned. Water is driven through the dishwasher 1 by a pump 7 disposed underneath the washing compartment 2. The dishwasher 1 includes a flow heater 10 that receives water from the pump 7 and delivers the heated water into the washing compartment 2 through water line 12 and riser tube 8 to an upper rack spray arm 5 and delivers the heated water as well into the washing compartment 2 through water line 13 and riser tube 9 to a lower spray arm 6.

During the rinse cycle, the washing liquid in the washing compartment 2 flows down and collects on the downwardly tapered bottom of the washing compartment 2. The downwardly tapered bottom of the washing compartment 2 channels this washing liquid to a dish-shaped sump 14 having an outlet 15 that is communicated with the pump 7. As seen in more detail in FIG. 2, the dish-shaped sump 14 supports therein a filter 16. The filter 16 has one side that faces the washing liquid exiting the washing compartment 2 and an opposite side facing away from the washing liquid exiting the washing compartment 2. An adhesion-reducing layer is provided on both sides of the filter 16, so that adhesion of dirt particles and/or bacteria is substantially reduced on both sides of the filter. The adhesion-reducing layer is preferably a diamond-like carbon coating and this coating advantageously makes It difficult for both particles and material to be filtered with dissolved constituents to adhere to the filter surfaces of the filter 16.

The invention claimed is:

1. A filter device, for use in a dishwasher comprising: at least one filter body with an influent filter surface and an effluent filter surface, the filter body being operable to filter aquiferous material that moves through the filter surface between the influent filter surface and the effluent filter surface with the influent filter surface being configured to resist adhesion of contaminants thereto, wherein both the influent filter surface and the effluent filter surface are configured to resist adhesion of contaminants thereto, and wherein the influent filter surface and the effluent filter surface are at least partially coated with diamond-like carbon.

2. A filter device, for use in a dishwasher comprising: at least one filter body with an influent filter surface and an effluent filter surface, the filter body being operable to filter aquiferous material that moves through the filter surface between the influent filter surface and the effluent filter surface with the influent filter surface being configured to resist adhesion of contaminants thereto, wherein the influent filter surface is configured to resist adhesion of contaminants thereto, and wherein the influent filter surface is at least partially coated with diamond-like carbon.

* * * * *